US005498176A

United States Patent [19]

Hashizawa et al.

[11] Patent Number: 5,498,176

[45] Date of Patent: Mar. 12, 1996

[54] SYSTEM FOR CONNECTING SHIELDING WIRE AND TERMINAL

[75] Inventors: Shigemi Hashizawa; Shigemitsu Inaba, both of Shizuoka, Japan

[73] Assignee: Yazaki Corporation, Tokyo, Japan

[21] Appl. No.: 252,235

[22] Filed: Jun. 1, 1994

[30] Foreign Application Priority Data

Jun. 8, 1993 [JP] Japan ..... 5-137390

[51] Int. Cl.[6] ..... H01R 9/05

[52] U.S. Cl. ..... 439/585; 439/610

[58] Field of Search ..... 439/578–585, 439/607, 609, 610, 874

[56] References Cited

U.S. PATENT DOCUMENTS

| | | | |
|---|---|---|---|
| 2,449,073 | 9/1948 | Johannssen | 439/578 |
| 4,370,630 | 1/1983 | Capek et al. | 439/578 |
| 4,688,876 | 8/1987 | Morelli | 439/578 |
| 4,772,223 | 9/1988 | Yasumoto | 439/578 |
| 5,151,053 | 9/1992 | Shinji et al. | 439/610 |

FOREIGN PATENT DOCUMENTS 58-147183 3/1982 Japan .

*Primary Examiner*—David L. Pirlot
*Attorney, Agent, or Firm*—Heslin & Rothenberg

[57] ABSTRACT

The present invention provides a system which can easily connect a shielding wire and a terminal in a shielding connector without damaging an internal sheath of the shielding wire and causing contact between a shielding layer and core wires of the shielding wire. The system has a shielding layer pressing member having an inner diameter substantially the same as the outer diameter of the internal sheath of the shielding wire, and shielding tube 7. The shielding layer pressing member is fitted to the terminal of the shielding layer exposed by stripping a terminal portion of the external sheath of the shielding wire, and is slid toward the remaining portion of the external sheath to contract the shielding layer. The shielding tube is inserted between the internal sheath and the external sheath with the contracted portion of the shielding layer therebetween and is fixed by caulking from the outside thereof. One end of the shielding tube is brought into contact with the inner surface of a connector housing to create continuity between the shielding layer and a connector housing.

11 Claims, 4 Drawing Sheets

SYSTEM FOR CONNECTING SHIELDING WIRE AND TERMINAL

BACKGROUND OF THE INVENTION

1. Field of the Invention

The present invention relates to a system for connecting a shielding wire and a terminal in a shielding connector used for, for example, electric wiring of automobiles.

2. Description of the Related Art

An example of conventional structures for connecting a terminal and this type of shielding wire is disclosed in Japanese Utility Model Laid-Open No. 58-147183. As illustrated in FIG. 4, a shielding wire 21 comprises core wires 25, an internal sheath 24 for covering the core wires 25, a shielding layer 23 comprising a conductive braid and provided on the outside of the internal sheath 24, and an external sheath 22 for covering the shielding layer 23. The core wires 25 are respectively connected to connector pins 27 which project from a connector case 26. An adapter 28 is provided for connecting a connector case 26 and the shielding layer 23 of the shielding wire 21. The adapter 28 has a metallic cylinder 29 and a spring 30 which projects from the outer surface of the cylinder 29. In the state where an end of the cylinder 29 is inserted between the internal sheath 24 of the shielding wire 21 and the shielding layer 23 thereof, a clamp fitting 31 is wound on the periphery of the external sheath 22 so as to bring the shielding layer 23 into contact with the adapter 28. The spring 30 is brought into contact with the inner surface of the connector case 26 to cause continuity between the shielding layer 23 and the connector case 26.

The above clamp structure requires handling of the terminal of the shielding wire 21, as shown in FIG. 5, before the shielding wire 21 is connected to the connector case 26. Namely, the terminal of the shielding wire 21 is cut with a cutter, and portions of the external sheath 22 and the shielding layer 23 are cut off, leaving the internal sheath 24. However, this work requires much labor even if it is performed by a person experienced. This is because if the cutter is applied shallowly, the shielding layer (braided wire) 23 is not cut, leaving mustache-like wires 23*a*, while if the cutter is applied deeply, the internal sheath 24 is cut, and the shielding layer 23 thus contacts the core wires 25.

SUMMARY OF THE INVENTION

The present invention has been achieved in consideration of the above problem of prior art.

An object of the present invention is to provide a system for connecting a shielding wire and a terminal in a shielding connector, which eliminates the need to cut and remove a shielding layer exposed by stripping a portion of an external sheath of a shielding wire.

Another object of the present invention is to provide a connecting system which does not damage an internal sheath of a shielding wire and thus prevents the danger of contact between a shielding layer and core wires.

In order to achieve the objects, the present invention provides a system for connecting a terminal and a shielding wire having core wires, an internal sheath for covering the core wires, a shielding layer for covering the internal sheath, and an external sheath for covering the shielding layer, the connecting system comprising a connector housing having a chamber for containing the shielding wire and the terminal, a shielding layer pressing member which comprises a tubular member having an inner diameter equal to or slightly smaller than the outer diameter of the internal sheath of the shielding wire, and which is fitted to the terminal portion of the shielding layer exposed by stripping a terminal portion of the external sheath of the shielding wire and is slid toward the remaining portion of the external sheath to contract the shielding layer, and a shielding tube which comprises a tubular member having an inner diameter larger than the outer diameter of the shielding layer, which is inserted between the internal sheath and the external sheath with the contracted portion of the shielding layer therebetween, and which has an end in contact with the inner surface of the connector housing so as to create continuity between the shielding layer and the connector housing.

In the above-described connecting system, the shielding layer exposed by stripping a portion of the external sheath need not be cut off, and the shielding layer pressing member may by fitted to the exposed portion of the shielding layer and slid toward the external sheath so as to press the shielding layer on the external sheath and contract the shielding layer along the internal sheath, thereby simplifying handling of the shielding wire terminal. Even if a cutter is applied deeply to the external sheath for cutting the external sheath, and even if a portion of the shielding layer is cut, the contraction makes the shielding layer dense and thus ensures a sufficient contact area between the shielding tube and the shielding layer. When a cutter is applied for cutting the external sheath, if the cutter is applied deeply, the shielding layer functions as a stopper for preventing the cutter from reaching the internal sheath. Unlike conventional systems, this system thus eliminates the danger that the shielding layer contacts the core wires due to cutting of the internal sheath.

Other objects, features and advantages of the present invention will be made clear from the attached drawings and the detailed description below.

DESCRIPTION OF THE PREFERRED EMBODIMENT OF THE INVENTION

Figure 1:
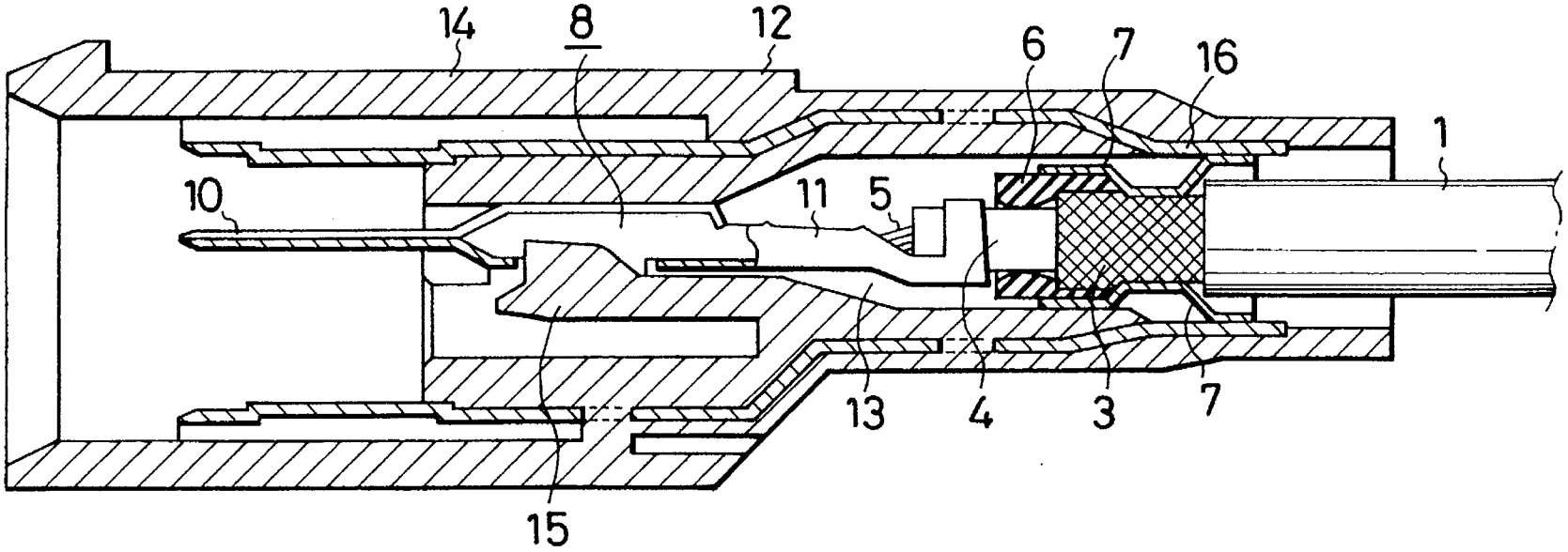
FIG. 1 is a longitudinal sectional view illustrating a principal portion of a shielding connector of a system for connecting a shielding wire and a terminal in accordance with an embodiment of the present invention.

FIG. 1 shows a principal portion of a shielding connector comprising a connector housing 12. The connector housing 12 includes a terminal chamber 13 for containing a male connector terminal 8 contact-bonded to the terminal of a shielding wire 1 therein. The connector terminal 8 has a body portion 9 in contact with the connector housing 12, a portion 10 to be connected to another terminal and a wire connecting portion 11 connected to the shielding wire 1. The terminal chamber 13 has a flexible locking arm 15 which forwardly extends along the inner wall thereof, and the body portion 9 of the connector terminal 8 has a locking hole 9*a* which engages the flexible locking arm 15 so as to prevent the terminal from slipping off. The connector housing 12 is provided with a hood 14 for receiving another connector (not shown).

Figure 2A:
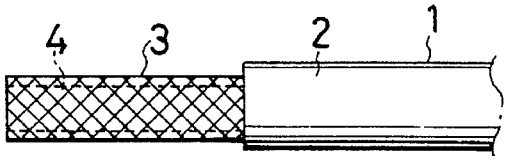
FIGS. 2A to 2E are drawings illustrating the process of connecting a shielding wire and a connector terminal.

As shown in FIG. 2A, the shielding wire 1 comprises an internal sheath 4 for covering core wires 5; a shielding layer 3 for covering the internal sheath 4, the shielding layer comprising, for example, a braid formed by braiding a conductive metal wire in a lattice form; and an external sheath 2 for covering the shielding layer 3. In the connecting portion between the shielding wire 1 and the connector terminal 8, the internal sheath 4 and the core wires 5 are connected and fixed, by caulking, to the wire connecting portion 11 of the connector terminal 8.

Figure 2B:
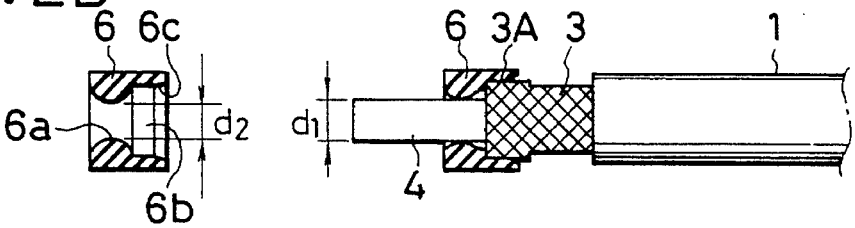

The shielding layer pressing member 6 is fitted over the internal sheath 4 and the shielding layer 3. The shielding layer pressing member 6 is made of an elastic insulating material such as synthetic rubber or the like. As shown in FIG. 2B, the shielding layer pressing member 6 has a wire through hole formed at the center thereof, the wire through hole having a small-diameter portion 6*a* and a large-diameter portion 6*b*. On the opening side of the large-diameter portion 6*b* is provided a insertion guide tapered portion 6*c*. The inner diameter $d_2$ of the small-diameter portion 6*a* is equal to or smaller than the outer diameter $d_1$ of the internal sheath 4, and the inner diameter of the large-diameter portion 6*b* is slightly larger than the outer diameter of the shielding layer 3.

Figure 2C:
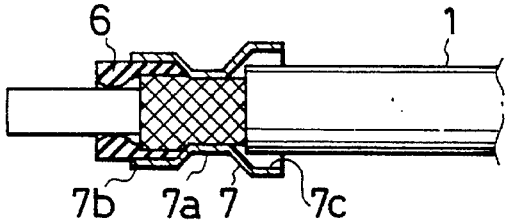

A metallic shielding tube 7, preferably metallic, is fitted over the shielding layer 3 and the shielding layer pressing member 6. The shielding tube 7 has a body portion 7*a* through which the shielding layer 3 is passed, a large-diameter portion 7*b* on one side of the body portion 7*a*, and a spring portion 7*c* on the other side, having a diameter larger than the outer diameter of the external sheath 2, as shown in FIG. 2C. These portions of the shielding tube 7 are integrally formed. The large-diameter portion 7*b* into which the shielding layer pressing member 6 is inserted, and the body portion 7*a* in contact with the shielding layer 3 are securely fixed in contact with the shielding layer pressing member 6 and the shielding layer 3 by caulking.

The process of connecting the shielding wire 1 and the connector terminal 8 is described below with reference to FIGS. 2A to 2E.

Referring to FIG. 2A, the external sheath 2 at the end of the shielding wire 1 is cut off in an appropriate length to expose a portion of the shielding layer 3.

Referring FIG. 2B, the shielding layer pressing member 6 is slid as shown by an arrow so as to press the shielding layer 3 on the external sheath 2 and contract the shielding layer by virtue of the presence of the small-diameter portion 6*a* in close contact with the periphery of the internal sheath 4. A portion or the whole of the contracted portion 3A of the shielding layer 3 is contained in the large-diameter portion 6*b*.

As shown in FIG. 2C, the shielding tube 7 is fitted over the shielding layer pressing member 6 and the external sheath at the end of the shielding wire 1, and the body portion 7*a* and the large-diameter portion 7*b* of the shielding tube 7 are securely fixed to the shielding wire 1 and brought into close contact with the shielding layer 3 by caulking using a jig (not shown).

Figure 2D:
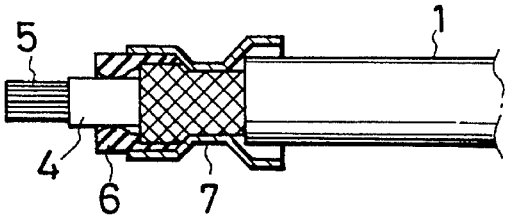
Figure 2E:
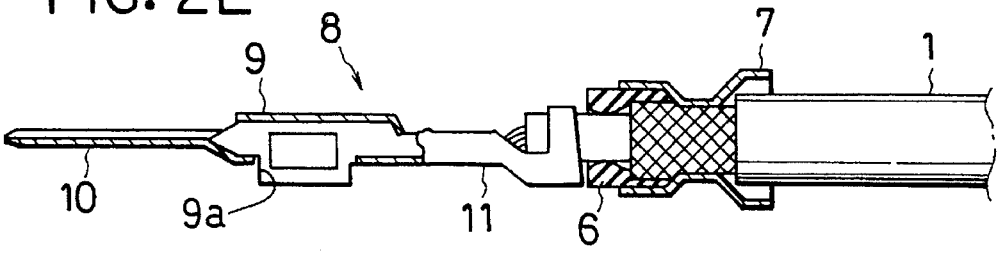

As shown in FIG. 2D, a portion of the exposed internal sheath 4 is cut off, and, as shown in FIG. 2E, the core wires 5 and the remaining internal sheath 4 are contact-bonded to the wire connecting potion 11 of the connector terminal 8 by a known means.

In the final step, the connector terminal 8 is contact-bonded to the shielding wire 1 and is contained in the connector housing 12, as described above (refer to FIG. 1), so that the spring portion 7c of the shielding tube 7 contacts a shielding plate 16 in contact with the inner wall of the housing 12. This brings about continuity between the shielding layer 3 and the housing 12 and securely achieves shielding of the connector portion at the terminal of the shielding wire 1.

As made clear from the continuous process shown in FIGS. 2A through 2E, connection between the shielding wire 1 and the connector terminal 8 is performed only by sliding the shielding layer pressing member 6 to push and contract the shielding layer 3 without the need to cut and remove a portion of the braided shielding layer 3. The work is thus extremely simple, and has no danger that the shielding layer 3 contacts the core wires 5 due to difficulties of the work.

Figure 3:
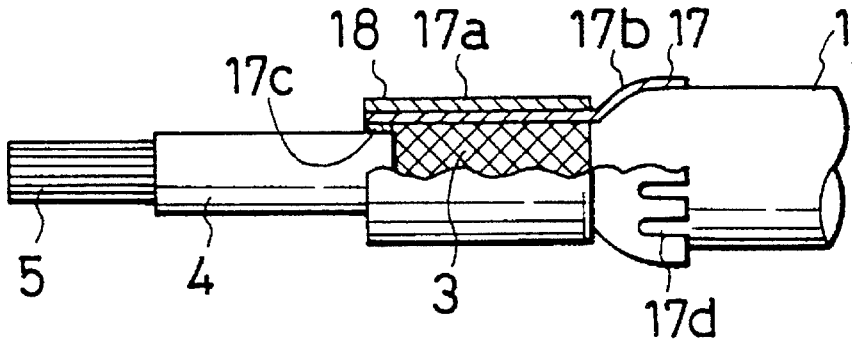
FIG. 3 is a drawing illustrating a connecting system in accordance with another embodiment of the present invention.
Figure 4:
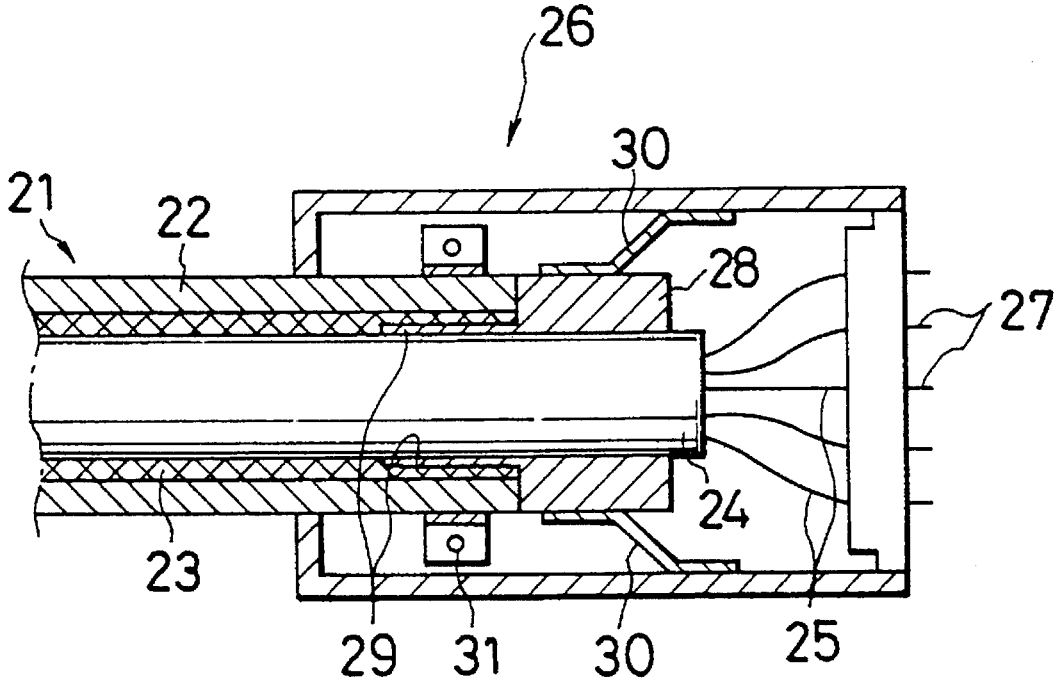
FIG. 4 PRIOR ART
FIG. 4 is a sectional view illustrating a conventional shielding connector.
Figure 5:
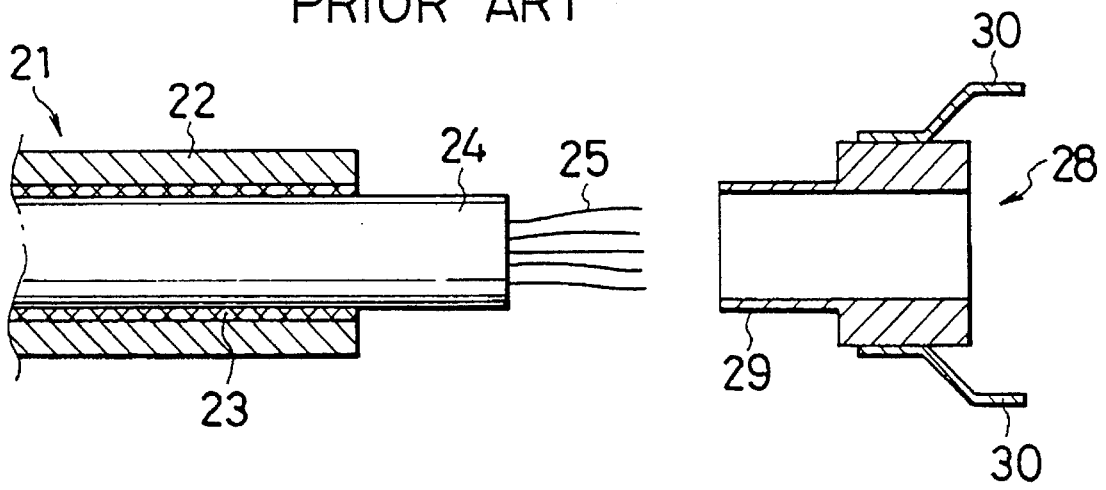
FIG. 5 PRIOR ART
FIG. 5 is a sectional view illustrating the state where the shielding wire and the connector terminal shown in FIG. 4 are separated from each other.
Figure 6:
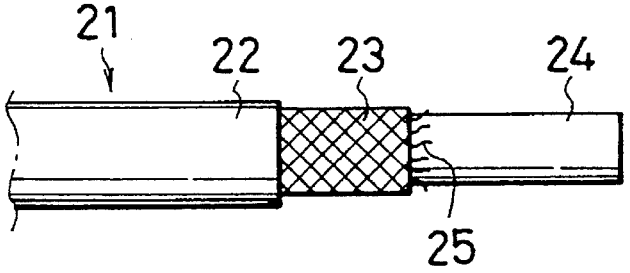
FIG. 6 PRIOR ART
FIG. 6 is a drawing illustrating the problem caused in handling of a shielding wire terminal of prior art.

FIG. 3 illustrates another embodiment of the present invention in which the shielding tube 7 and the shielding layer pressing member 6 are integrally formed.

In this embodiment, a shielding tube 17 is preferably metallic and comprises a body portion 17*a* for containing the shielding layer 3 of the shielding wire therein, a skirt-like spring portion 17*b* which is continued from one end of the body portion 17*a*, and a shielding layer pressing portion 17*c* provided on the other side and having a hole having a diameter substantially the same as the outer diameter of the internal sheath 4. An insulating coating layer 18 is provided on the periphery of the body portion 17*a*. The spring portion 17*b* preferably has a plurality of notches 17*d* for facilitating elastic deformation.

In this embodiment, since the shielding layer pressing member 6 and the shielding tube shown in FIG. 1 are integrated into the shielding tube 17 as a single part, the number of parts and the number of continuous steps are decreased. The handling work is further simplified.

As described above, the present invention relates to the structure for connecting the shielding wire and the connector terminal of the shielding connector in which the shielding wire is brought into contact with the connector terminal so as to cause continuity between the shielding layer and the connector housing. In this connecting structure, the shielding layer pressing member having an inner diameter equal to or slightly smaller than the outer diameter of the shielding wire is fitted to the terminal portion of the shielding layer which is exposed by stripping a portion of the external sheath of the shielding wire, slid toward the remaining external sheath of the shielding wire to contract the exposed portion of the shielding layer, and the shielding tube having an inner diameter larger than the outer diameter of the shielding layer is inserted between the internal sheath and the external sheath with the contracted portion of the shielding layer therebetween. The shielding layer is brought into contact with the shielding tube by caulking the contracted portion of the shielding layer from the outside. In addition, one end of the shielding tube is brought into contact with the inner surface of the connector housing to create continuity between the shielding layer and the connector housing. This structure does not damage the internal sheath and thus eliminates the danger of contact between the shielding layer and the core wires, thereby facilitating the connecting work.

What is claimed is:

1. A system for connecting a connector terminal and a shielding wire having core wires, an internal sheath for covering said core wires, a shielding layer for covering said internal sheath and an external sheath for covering said shielding layer in a shielding connector, said system comprising:

a connector housing having a containing chamber for containing said shielding wire and a terminal; and means which has a tubular member having an inner diameter equal to or slightly smaller than the outer diameter of said internal sheath of said shielding wire, which is fitted to an end portion of said shielding layer exposed by stripping a terminal portion of said external sheath of said shielding wire and is slid toward the remaining external sheath to contract the exposed portion of said shielding layer, said means being brought into contact with said shielding layer by caulking the contracted portion of said shielding layer portion, and one end-of said means being brought into contact with the inner surface of said connector housing to create continuity between said shielding layer and said connector housing.

2. A system according to claim 1, wherein said means is integrally formed by a metal.

3. A system according to claim 1, wherein said means comprises a shielding layer pressing member which comprises a tubular member having an inner diameter equal to or slightly smaller than the outer diameter of said shielding wire, and which is fitted to the terminal of said shielding layer exposed by stripping the terminal portion of said external sheath of said shielding wire and is slid toward the remaining external sheath to contract said exposed shielding layer, and a shielding tube which comprises a tubular member having an inner diameter larger than the outer diameter of said shielding layer, which is inserted between said internal sheath and said external sheath with said contracted portion of said shielding layer therebetween, and which is caulked in said contracted portion of said shielding layer to contact said shielding layer, one end of said shielding tube being brought into contact with the inner surface of said connector housing to create continuity between said shielding layer and said connector housing.

4. A system according to claim 3, wherein said shielding tube comprises a body portion which is brought into contact with said shielding layer by caulking, and a large-diameter portion which is caulked through the shielding layer pressing member.

5. A system for connecting a connector terminal and a shielding wire having core wires, an internal sheath for covering said core wires, a shielding layer for covering said internal sheath and an external sheath for covering said shielding layer in a shielding connector, said system comprising:

a connector housing having a containing chamber for containing said shielding wire and a terminal; and means which has a tubular member having an inner diameter equal to or slightly smaller than the outer diameter of said internal sheath of said shielding wire, which is fitted to the terminal of said shielding layer exposed by stripping a terminal portion of said external sheath of said shielding wire and is slid toward the remaining external sheath to contract the exposed portion of said shielding layer, said means being brought into contact with said shielding layer by caulking the contracted portion of said shielding layer portion, and one end of said means being brought into contact with the inner surface of said connector housing to create continuity between said shielding layer and said connector housing, wherein said means comprises a shielding layer pressing member which comprises a tubular member having an inner diameter equal to or slightly smaller than the outer diameter of said shielding wire, and which is fitted to the terminal of said shielding layer exposed by stripping the terminal portion of said external sheath of said shielding wire and is slid toward the remaining external sheath to contract said exposed shielding layer, and a shielding tube which comprises a tubular member having an inner diameter larger than the outer diameter of said shielding layer, which is inserted between said internal sheath and said external sheath with said contracted portion of said shielding layer therebetween, and which is caulked in said contracted portion of said shielding layer to contact said shielding layer, one end of said shielding tube being brought into contact with the inner surface of said connector housing to create continuity between said shielding layer and said connector housing, wherein said shielding tube comprises a spring portion having a diameter larger than the outer diameter of the external sheath of said shielding layer, the said connector housing contacting said spring portion through a shielding plate.

6. A system for connecting a connector terminal and a shielding wire having core wires an internal sheath for covering said core wires, a shielding layer for covering said internal sheath and an external sheath for covering said shielding layer in a shielding connector, said system comprising:

a connector housing having a containing chamber for containing said shielding wire and a terminal: and means which has a tubular member having an inner diameter equal to or slightly smaller than the outer diameter of said internal sheath of said shielding wire, which is fitted to the terminal of said shielding layer exposed by stripping a terminal portion of said external sheath of said shielding wire and is slid toward the remaining external sheath to contract the exposed portion of said shielding layer, said means being brought into contact with said shielding layer by caulking the contracted portion of said shielding layer portion, and one end of said means being brought into contact with the inner surface of said connector housing to create continuity between said shielding layer and said connector housing, wherein said means comprises a shielding layer pressing member which comprises a tubular member having an inner diameter equal to or slightly smaller than the outer diameter of said shielding wire, and which is fitted to the terminal of said shielding layer exposed by stripping the terminal portion of said external sheath of said shielding wire and is slid toward the remaining external sheath to contract said exposed shielding layer, and a shielding tube which comprises a tubular member having an inner diameter larger than the outer diameter of said shielding layer, which is inserted between said internal sheath and said external sheath with said contracted portion of said shielding layer therebetween, and which is caulked in said contracted portion of said shielding layer to contact said shielding layer, one end of said shielding tube being brought into contact with the inner surface of said connector housing to create continuity between said shielding layer and said connector housing, wherein said shielding layer pressing member is made of an elastic insulating material.

7. A system for connecting a connector terminal and a shielding wire having core wires, an internal sheath for covering said core wires, a shielding layer for covering said internal sheath and an external sheath for covering said shielding layer in a shielding connector, said system comprising:

a connector housing having a containing chamber for containing said shielding wire and a terminal; and means which has a tubular member having an inner diameter equal to or slightly smaller than the outer diameter of said internal sheath of said shielding wire, which is fitted to the terminal of said shielding layer exposed by stripping a terminal portion of said external sheath of said shielding wire and is slid toward the remaining external sheath to contract the exposed portion of said shielding layer, said means being brought into contact with said shielding layer by caulking the contracted portion of said shielding layer portion, and one end of said means being brought into contact with the inner surface of said connector housing to create continuity between said shielding layer and said connector housing, wherein said means is integrally formed by a metal, and wherein said means comprises a body portion for containing said shielding layer therein, and a skirt-like spring portion continued from one end of said body portion, said shielding layer pressing member being connected to the other side of said body portion.

8. A system according to claim 7, further comprising an insulating coating layer provided on the periphery of said body portion.

9. A system according to claim 7, wherein said spring portion is provided with a plurality of notches.

10. A method of connecting a terminal and a shielding wire having core wires, an internal sheath for covering said core wires, a shielding layer for covering said internal sheath and an external sheath for covering said shielding layer, said method comprising the steps of:

preparing a connector housing having a terminal chamber for containing said shielding wire and said terminal, a first tubular member having an inner diameter equal to or slightly smaller than the outer diameter of said internal sheath of said shielding wire, and a second tubular member having an inner diameter larger than the outer diameter of said shielding layer and provided with continuity with said connector housing;

exposing a portion of said shielding layer by stripping said external sheath at the terminal end of said shielding wire, fitting said first tubular member to the exposed portion of said shielding layer and sliding said first tubular member toward the remaining external sheath portion to contract the exposed portion of said shielding layer, and exposing a portion of said internal sheath;

inserting said second tubular member between said internal sheath and said external sheath with said contracted portion of said shielding layer therebetween, and caulking said second tubular member and said contracted portion of said shielding layer to bring said second tubular member into contact with said shielding layer; and contacting an end of said second tubular member with the inner surface of said connector housing to create continuity between said shielding layer and said connector housing.

11. A method of connecting a terminal and a shielding wire having core wires, an internal sheath for covering said core wires, a shielding layer for covering said internal sheath and an external sheath for covering said shielding layer, said method comprising the steps of:

preparing a connector housing having a chamber for containing said shielding wire and said terminal, and a tubular member comprising a body portion having an inner diameter larger than the outer diameter of said shielding layer, a shielding layer pressing portion provided on one side of said body portion and having an inner diameter equal to or slightly smaller than the outer diameter of said internal sheath of said shielding wire, and a spring portion provided on the other side of said body portion;

exposing a portion of said shielding layer by stripping a terminal portion of said external sheath of said shielding wire, fitting said tubular member to the exposed portion of said shielding layer and sliding said tubular member toward the remaining portion of said external sheath to contract the exposed portion of said shielding layer, and exposing a portion of said internal sheath;

caulking said tubular member through said contracted portion of said shielding layer to bring said tubular member into contact with said shielding layer; and contacting an end of said second tubular member with the inner surface of said connector housing to create continuity between said shielding layer and said connector housing.

* * * * *